US005813710A

United States Patent [19]

Anderson

[11] Patent Number: 5,813,710

[45] Date of Patent: Sep. 29, 1998

[54] FLUSH LOCK ACTUATOR

[75] Inventor: Todd A. Anderson, Conyngham, Pa.

[73] Assignee: Truth Hardware Corporation, Owatonna, Minn.

[21] Appl. No.: 841,928

[22] Filed: Apr. 8, 1997

[51] Int. Cl.[6] ..... E05B 3/00

[52] U.S. Cl. ..... 292/336.3; 292/161; 292/DIG. 20; 292/DIG. 31; 292/244; 292/150

[58] Field of Search ..... 292/244, 161, 292/157, 139, 143, 150, DIG. 20, DIG. 31, DIG. 33, DIG. 37, 336.3; 70/208

[56] References Cited

U.S. PATENT DOCUMENTS

| | | | |
|---|---|---|---|
| D. 316,509 | 4/1991 | Nolte . | |
| D. 334,132 | 3/1993 | Wobschall et al. . | |
| 1,256,992 | 2/1918 | Edgar et al. | 292/DIG. 31 |
| 3,109,675 | 11/1963 | Anderson . | |
| 3,250,558 | 5/1966 | McClintock | 292/DIG. 21 |
| 3,949,525 | 4/1976 | Bates et al. . | |
| 4,059,298 | 11/1977 | Van Klompenburg . | |
| 4,095,829 | 6/1978 | Van Klompenburg . | |
| 4,813,725 | 3/1989 | Mosch . | |
| 4,937,976 | 7/1990 | Tucker et al. . | |
| 4,973,091 | 11/1990 | Paulson et al. . | |
| 4,991,886 | 2/1991 | Nolte et al. . | |
| 5,087,087 | 2/1992 | Vetter et al. . | |
| 5,118,145 | 6/1992 | Tucker . | |
| 5,457,971 | 10/1995 | Yamada | 292/DIG. 31 |
| 5,556,145 | 9/1996 | Takasaki | 292/336.3 |
| 5,620,213 | 4/1997 | Ellis | 292/DIG. 20 |

OTHER PUBLICATIONS

Truth brochure "Concealed Casement Hardware–Lock" (1991), pp. 13.1–13.1b.

Truth brochure "Locking Handle" (1988), pp. 14–14e.

Truth brochure "Sash Lock" (1996) pp. 2.1–2.1a.

Truth brochure "Non–Handed, Low Profile Sash Lock" (1996), pp. 2.2–2.2c.

Truth brochure "Home Gard™ Sash Lock" (1996), pp. 2.3–2.3c.

Truth brochure "EntryGard® Sash Lock" (1996), pp. 2.4–2.4c.

Truth brochure "Locking Handle" (1996), pp. 2.7–2.7g.

Truth brochure "Multi–Point Locking System" (1996), pp. 2.8–2.8g.

*Primary Examiner*—Rodney M. Lindsey

*Attorney, Agent, or Firm*—Wood, Phillips, VanSanten, Clark & Mortimer

[57] ABSTRACT

A lock for securing a window sash against a window frame, including a housing mountable on a face of the window frame, and a handle extending generally longitudinally between first and second ends and pivotable in the housing about an axis disposed substantially halfway between the handle ends and oriented substantially transverse to the handle longitudinal direction. The handle includes a pivot at each handle end, and a pivot link is pivotably securable on one end to a window locking mechanism and pivotably securable on its other end to a selected one of the handle pivots. The housing has a substantially planar first face which is substantially the entire surface of the handle visible in the housing opening when the handle is in the first position and is substantially co-planar with the housing first face when the handle is in the first position. A slide is selectively movable into a recess in one of the handle ends to block pivoting of the handle. Manual movement of the handle from the first position to the second position may be initiated by pushing the actuator first face at one end.

17 Claims, 2 Drawing Sheets

FLUSH LOCK ACTUATOR

BACKGROUND OF THE INVENTION

1. TECHNICAL FIELD

The present invention is directed toward window locks, and more particularly toward manual handles for actuating window locks.

2. BACKGROUND ART

Window locks are known in the art and generally have a catch operable by a handle actuator mounted to a window frame, where the catch cooperates with a keeper on a corresponding section of a movable window sash to securely hold the sash tightly against the frame. Also known in the art are devices for sequential multi-point locking of a movable window sash, where multiple catches and keepers are provided, with the catches generally being interconnected by a tie bar which is moved by a handle actuator.

U.S. Pat. Nos. 4,991,886, 5,087,087 and 5,118,145, the contents of which are hereby incorporated by reference, disclose such multipoint locks for a window sash. These devices generally use a tie bar connecting two or more spaced apart cam members or rollers which can interact with keepers affixed to a window sash to establish a locked condition of the window. The movement of a handle actuator from its unlocked position causes the adjacent roller on the tie bar to connect with a planar portion of an associated ramped keeper. Continued movement of the handle actuator causes the tie bar to also move the second roller onto the planar section of the second associated ramped keeper.

As can be seen from the various handle actuators shown in these patents, simple operation of locking structures such as shown therein may be inexpensively and reliable provided by a pivotable handle which is manually engagable by a person located inside the dwelling.

However, these locks, as with all locks, most importantly prevent unauthorized access through the windows by allowing the window sash to be secured against unauthorized opening. Willful intruders will, however, attempt to pick the locks from the outside of the window in order to attempt to gain access. U.S. Pat. Nos. 4,991,886 and 5,087,087 therefore include special structures requiring a pin and slot connection between the handles and the tie bars to prevent such unauthorized access.

Also, such handles have tended to interfere with blinds and curtains, in some cases preventing them from hanging properly and thereby creating an unattractive look for the window and blinds or curtains. Further, such handles are susceptible to being accidentally bumped by a person not intending to operate the window lock. A person who accidentally bumps the handle could damage or even break the handle. At a minimum, such bumping can cause the handle to be soiled and/or scratched, and thereby result in an aesthetic eyesore at the edge of the area (the window) typically intended to attract visual attention. The person might also himself/herself be bruised or hurt from bumping into the handle. Still further, bumping of the handle could result in some pivoting of the handle, thereby possible inadvertently and unknowingly changing the condition of the lock. Particularly when it is not recognized that the lock condition has been changed, the result can be either a dangerous situation (where the occupant wrongly believes the window is securely locked) or a potentially window damaging situation (for example, if the window is open but the lock is inadvertently moved to a locking position, subsequently moving the window sash to a closed position could cause damage to the window and/or its lock or operator as a result of jamming the sash against the interfering locking structure).

Of course, it is also a primary object of windows to provide an aesthetically pleasing appearance and an open feel to the room. It is therefore desirable that the visible window hardware components (the handle being perhaps the most prominent) be themselves not only aesthetically pleasing but also minimally intrusive on, or distracting from, the open view through the window. Simply put, a window should draw a person's attention to the opening therethrough, not to the hardware components located along the side of the window. Such minimal intrusion must, however, be weighed against the need for an accessible and easily operable manual window lock handle.

It is also generally desirable for components of a window lock to be simply yet reliably connected to facilitate assembly and servicing of the structure throughout its useful life. Of course, it is also desirable that such a structure not only facilitate the installation and service of the lock, but also that the structure allow easy and reliable use of the lock over a long useful life. Still further, it is desirable that this be provided with an assembly which is simple and inexpensive to manufacture, and which can be used in a plurality of installations, including retrofitting into existing window structures.

It is still further desirable to provide window hardware components, such as components for window locks, which may be readily used with both right and left handed opening windows, without requiring additional inventory of components for both types of installations. Components which may be used with both types of installations also minimize problems and costs associated with delivery of the wrong components to a particular installation.

The present invention is directed toward providing a handle actuator meeting the above needs.

SUMMARY OF THE INVENTION

In one aspect of the present invention, a lock for securing a window sash against a window frame is provided, including a housing mountable on a face of a window frame, the housing including a first face surface that surrounds an opening in the housing, and a handle pivotable on the housing within the opening between a first position where a window sash is locked to a window frame and a second position where a window sash is released from a window frame. The handle has a second face surface which is substantially the entire surface of the handle visible in the housing opening when the handle is in the first position, the second face surface being substantially flush with the first face surface when the handle is in the first position.

In a preferred form of this aspect of the present invention, movement of the handle from the first position to the second position may be manually initiated by pushing the handle second face at one end of the handle.

In another preferred form of this aspect of the present invention, the handle is pivotable about an axis disposed between ends of the handle, and a slide is selectively movable into a recess in one of the handle ends whereby the slide blocks pivoting of the handle.

In still other preferred forms of this aspect of the present invention, the housing first face surface is substantially planar, and the handle second face surface is substantially planar, and the housing first face surface and the handle second face surface are substantially co-planar when the handle is in the first position.

In another aspect of the present invention, a lock for securing a window sash against a window frame is provided, including a housing mountable on a face of a window frame, and a handle extending generally longitudinally between first and second ends and pivotable in the housing about an axis which is disposed substantially halfway between the handle ends and oriented substantially transverse to the longitudinal direction of the handle. The handle includes structure on each handle end for selectively connecting one of the handle ends to a mechanism for locking the window sash to the window frame.

In a preferred form of this aspect of the present invention, the handle is substantially symmetrical about the axis.

In another preferred form of this aspect of the present invention, the connecting structure is a pivot at each end of the handle, and a pivot link is pivotably securable on one end to a locking mechanism and pivotably securable on its other end to a selected one of the handle pivots.

In yet another preferred form of this aspect of the present invention, the housing has a substantially planar first face substantially parallel to the window frame face when the housing is mounted to the window frame, and the handle has a substantially planar second face which is substantially co-planar with the housing first face when the handle is in the first position.

In still another preferred form of this aspect of the present invention, movement of the handle from a first position where the window sash is locked to the window frame to a second position where the window sash is released from the window frame may be manually initiated by pushing the handle second face at the end of the handle selectively connected to the locking mechanism.

In still another aspect of the present invention, a lock for securing a window sash against a window frame is provided, including at least one keeper mountable on a window sash, and at least one locking member mountable on a window frame for movement between a first position interfering with the at least one keeper mounted to the window sash to lock the window sash to the window frame when the window sash is in a closed position relative to the window frame and a second position clear of the at least one keeper to allow movement of the window sash relative to the window frame. A housing is mountable on a face of a window frame, and includes a first face surface that surrounds an opening in the housing. A handle is pivotable in the housing opening and operably secured to the at least one locking member whereby pivoting of the handle moves the at least one locking member between the first position and the second position. The handle has a second face surface which is substantially the entire surface of the handle visible in the housing opening when the handle is in the first position. The second face surface is substantially flush with the first face surface when the handle is in the first position.

In a preferred form of this aspect of the present invention, manual movement of the handle from the first position to the second position may be initiated by pushing the handle first face at one end of the handle.

In another preferred form of this aspect of the present invention, a second keeper is provided, the keepers being mountable at spaced positions on the window sash. A reciprocable tie bar is mountable to a window frame and operably secured to the handle whereby pivoting of the handle moves the tie bar. A second locking member is also provided, the locking members being mounted at spaced positions on the tie bar whereby reciprocation of the tie bar moves the locking members between the first position and the second position.

In still another preferred form of this aspect of the present invention, the locking member is a cam.

In yet another preferred form of this aspect of the present invention, the handle is pivotable about an axis disposed between ends of the handle, and a slide is selectively movable into a recess in one of the handle ends to block pivoting of the handle.

In still another preferred form of this aspect of the present invention, both the housing first face surface and the handle second face surface are substantially planar, and the housing first face surface and the handle second face surface are substantially co-planar when the handle is in the first position.

In yet another aspect of the present invention, an actuator controlling securing of a first member relative to a second member is provided, including a housing mountable on a face of a first member and having a peripheral wall surrounding an opening in the housing with an aperture extending through the wall. An actuator handle has a recess in a first end and pivotable in the housing opening between a first position for securing a first member to a second member and a second position for releasing a first member for movement relative to a second member. A locking member is translatable in the aperture between a first position received in the recess to prevent pivoting of the handle relative to the housing and a second position free from the recess to allow pivoting of the handle relative to the housing.

In a preferred form of this aspect of the present invention, the actuator is secured for pivoting about an axis fixed to the housing, and the actuator first end is radially spaced from the axis.

In another preferred form of this aspect of the present invention, the actuator is a manually engagable handle.

In still another preferred form of this aspect of the present invention, manual movement of the actuator from the first position to the second position is initiated by pushing the actuator first face at the first end.

It is an object of the present invention to provide a lock handle actuator which operates easily, efficiently and reliably over the long life of the. window structure which it locks.

It is another object of the present invention to provide an aesthetically pleasing handle actuator which is also minimally intrusive into the view of the window structure with which it is used and does not otherwise intrude on the appearance of the window by interfering with proper hanging of blinds or curtains.

It is still another object of the present invention to provide a lock handle actuator which will be unlikely to be scratched, bent or otherwise damaged from accidental contact by a person in the dwelling in which the handle is located.

It is yet another object of the present invention to provide a lock handle actuator which protects against unrecognized accidental or inadvertent unlocking of the window, and which further provides security against picking by a potential intruder.

Another object of the present invention is to provide a lock handle actuator which may be inexpensively manufactured, inventoried, shipped, installed and maintained for all types of installations, and which may be used to minimize the cost of shipping assembled window structures.

DESCRIPTION OF THE PREFERRED EMBODIMENT

Figure 1:
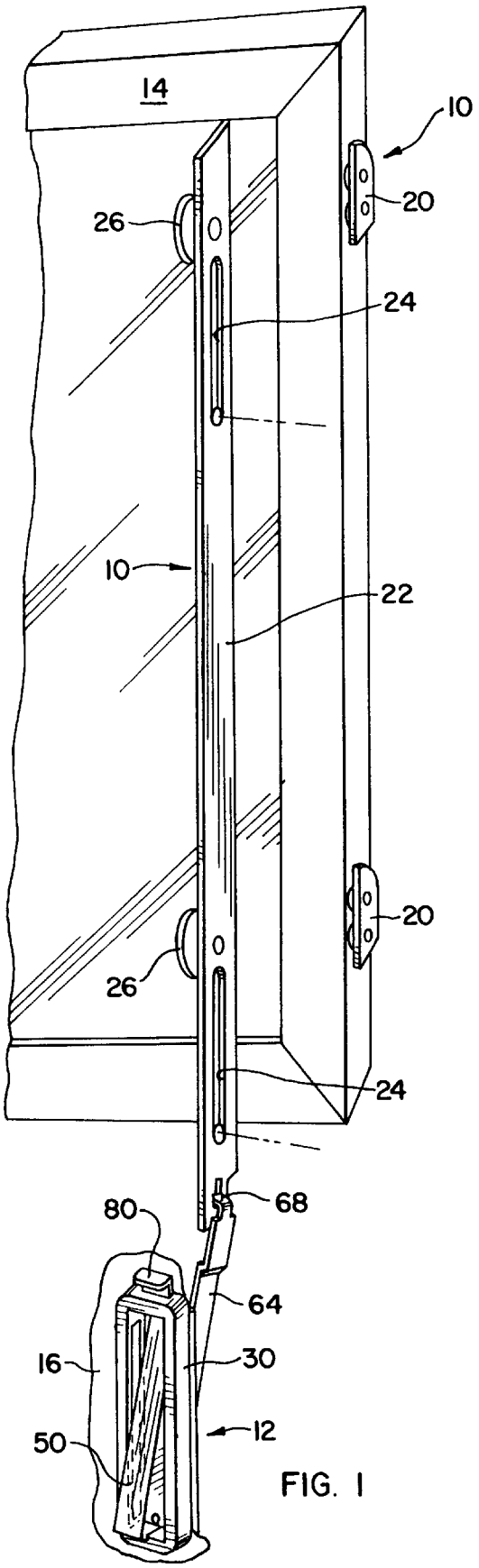
FIG. 1 is a partially broken away perspective view of a window sash and frame having a multipoint lock and the lock actuator of the present invention, with the lock in the open position.
Figure 2:
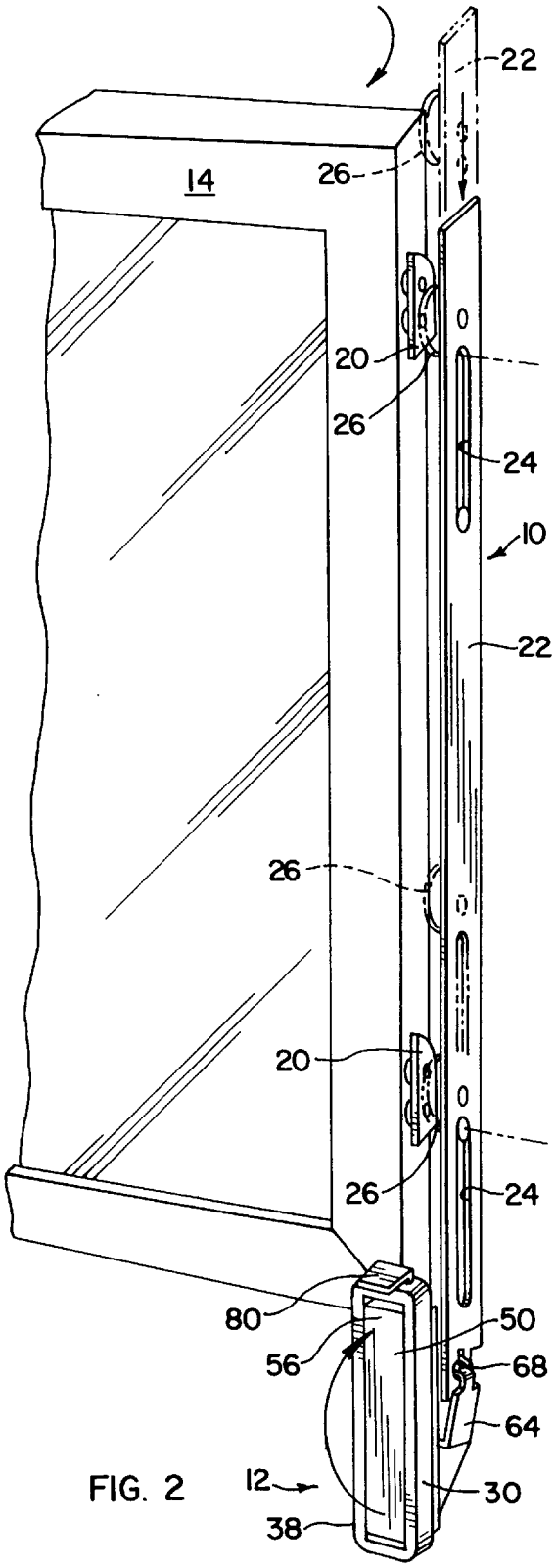
FIG. 2 is a view similar to FIG. 1, showing the lock in the locking position.
Figure 3:
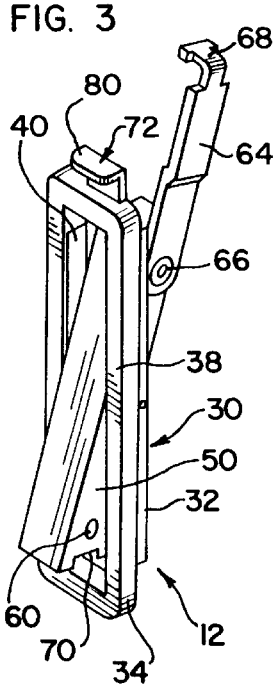
FIG. 3 is a perspective view of the lock actuator of the present invention, with the lock actuator in a normally open position.
Figure 4:
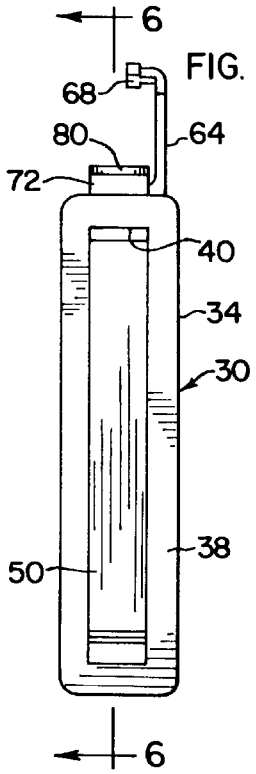
FIG. 4 is a front view of the lock actuator of FIG. 3.
Figure 5:
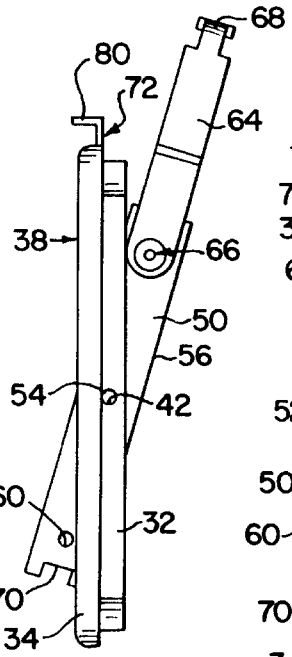
FIG. 5 is a side view of the lock actuator of FIG. 3.

A multi-point lock structure 10 operable by a lock actuator 12 of the present invention is shown in FIGS. 1–2 for securing a window sash 14 to a window frame 16.

In the illustrated embodiment, the sash 14 includes a pair of spaced keepers 20 suitably mounted along one side. Secured to the window frame 16 in a suitable manner is a tie bar 22 which may be moved vertically along its longitudinal length (for example, but use of a pin and slot connection 24 as shown, or by use of a suitable guide such as shown in U.S. Pat. Nos. 5,045,265 and 5,118,145). Suitable cam members 26 (see, for example, the rollers shown in U.S. Pat. No. 5,118,145) are secured to the tie bar 22 at spaced positions. As should be understood by one of skill in this art, the cam members 26 may thus be moved vertically between a locking position vertically aligned with cooperating keepers 20 and a releasing position vertically spaced from the cooperating keepers 20. When the window sash 14 is opened, the tie bar 22 is preferably in its upper position (as shown in FIG. 1 and in phantom in FIG. 2) so that the window sash 14 may be freely moved into the closed position against the frame 16 without any interference from the cam members 26.

When the sash 14 is in the closed position against the frame 16, the tie bar 22 is moved down as described in greater detail hereafter and as shown in FIG. 2 so that the cam members 26 secured to the tie bar 22 overlap with the cooperating keepers 20 and thereby block the keepers 20 to prevent the keepers 20 and sash 14 from being moved from the closed position, that is, the window sash 14 is then locked shut.

Multi-point lock structures 10 such as illustrated in FIGS. 1–2 are typically used with larger windows. With such installations, sequential locking can be provided if desired by providing slightly different spacing between the keepers 20 and the cam members 26 as described in detail in U.S. Pat. No. 4,991,886. It should, however, be understood that the handle 12 of the present invention could also be used with structures locking at only a single point, such as typically used with smaller size window sashes, as the handle 12 of the present invention could readily be used with virtually any locking structure which may be actuated by a pivoting handle, including those locking structures which actually rely upon linear motion such as in the illustrated multi-point lock structure 10.

Referring now to the lock actuator 12, a substantially rectangular housing 30 is provided including a substantially rectangular base flange 32 suitably secured in a suitable opening in the window frame 16 (for example, by screws [not shown] extending from the back [exterior] side of the frame 16). A peripheral lip 34 extends outwardly on the side of the housing 30 facing the interior of the dwelling, and includes a substantially planar face surface 38 which, in the preferred embodiment, is substantially parallel to the face of the window frame 16 to which the housing is attached (see FIG. 6).

The housing 30 has a longitudinally extending opening 40 therethrough. Aligned pivot openings 42 extend through the housing base flange 32 at substantially the longitudinal midpoint on opposite sides of the housing opening 40.

A longitudinal handle 50 has a central pivot opening 52 through which a suitable pivot pin 54 extends, where the pivot pin 54 also extends through the housing pivot openings 42 and is suitably secured therein (for example, by deforming ends of the pin 54 extending outwardly from the housing pivot openings 42), so that the handle 50 is pivotable in the housing opening 40 about the center of the handle 50 (in the preferred embodiment, the handle 50 is symmetrical about its central pivot opening 52). It should be understood, however, that still other structures could be used within the scope of the present invention to suitably secure the handle 50 for pivoting in the housing opening 40.

Figure 7:
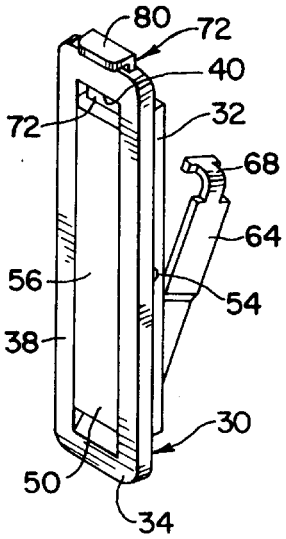
FIG. 7 is a perspective view of the lock actuator of the present invention, with the lock actuator in a normally locking position.
Figure 8:
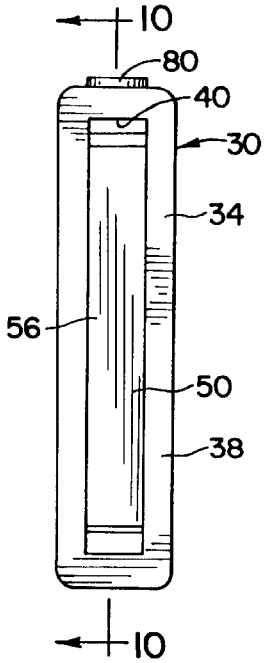
FIG. 8 is a front view of the lock actuator of FIG. 7.
Figure 9:
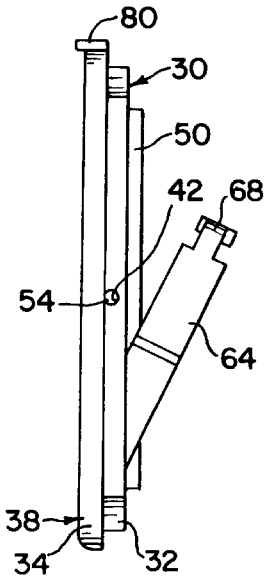
FIG. 9 is a side view of the lock actuator of FIG. 7.

The handle 50 also has a substantially planar face surface 56 which is substantially the entire surface of the handle 50 visible in the housing opening 40 when the handle 50 is in its locking position. Further, in the preferred embodiment, the handle face surface 56 is substantially coplanar with the housing face surface 38 when the handle 50 is in its locking position (as best shown in FIG. 7). By providing a symmetrical handle 50 as previously mentioned, opposite sides of the handle 50 are substantially identical so that such an co-planar orientation can be provided (providing ideal aesthetic and operational characteristics as discussed hereafter) no matter what the particulars of the installation of the lock actuator 12.

Connecting recesses or openings 60 are provided at both ends of the longitudinal handle 50, which openings 60 are used to selectively connect one end of the handle 50 to one end of a pivot link 64 by any suitable means (for example, a rivet 66). The other end of the pivot link 64 has suitable structure for connecting to the lock structure 10 (in the preferred embodiment, a connecting ear 68 for connecting to the tie bar 22 of the lock structure 10). By providing openings 60 on both ends of the handle 50, the lock actuator 12 can be used in different installations, including different handed window sash mountings, without requiring special inventory of differently configured actuators for different installations.

Of course, it should also be understood that it would still be within the scope of the present invention to use other structures for operably connecting the handle to the lock structure.

Figure 6:
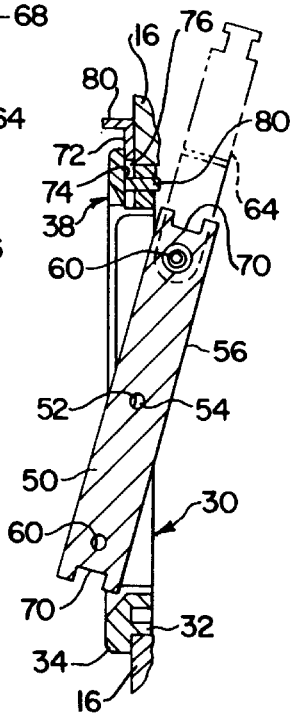
FIG. 6 is a side cross-sectional view taken along line 6—6 of FIG. 4.
Figure 10:
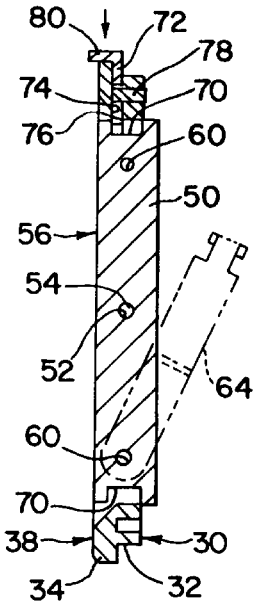
FIG. 10 is a side cross-sectional view taken along line 10—10 of FIG. 8.

In the preferred embodiment, the handle 50 also includes a recess 70 in opposite ends, with a locking member 72 slidably received in an aperture 74 at one end of the housing 30. As best seen in FIGS. 6 and 10, the locking member 72 includes a slot 76 within which is received a retaining member 78 fixed to the housing 30, the slot 76 and retaining member 78 cooperating to retain the locking member 72 in the housing aperture 74 while also allowing the locking member 72 to reciprocate between a first position clear of the housing opening 40 allowing pivoting of the handle 50 in the housing 30 as shown in FIG. 6 to a second position extending into the housing opening 40 and one recess 70 in one end of the handle 50 which prevents the handle 50 from being pivoted as shown in FIG. 10.

With this preferred embodiment, the handle 50 may be readily secured in a locking position with the connected lock structure 10 in a locking position as shown in FIG. 2, and the locking member 72 positioned as in FIGS. 7–10 secures the assembly in this configuration, preventing picking of the lock should a potential intruder be able to manipulate the tie bar 22 or other components of the lock structure 10 from outside the dwelling.

The locking member flange 80 may nevertheless be easily moved up by a person in the dwelling (for example, by pushing up with their thumb on the portion of the flange 80 which extends inwardly beyond the housing face surface 38 (see FIGS. 9–10) to move the locking member 72 to the FIG. 6 position. In that position, the person may easily push in on the bottom of the face surface 56 of the handle 50 to pivot the handle 50 counterclockwise from the locking position shown in FIGS. 7–10 toward the unlocked or releasing position shown in FIGS. 3–6 (once pivoting has begun in this manner, further pivoting may be accomplished by grasping the upper end of the handle 50 which, at that point, will project into the dwelling and be readily engagable on its end for further manual pivoting.

It should thus be recognized that the lock actuator 12 of the present invention will operate easily, efficiently and reliably over the long life of the window structure which it locks. Further, this design provides clean sight lines with a visually attractive configuration which is minimally intrusive. Not only is such minimal intrusion aesthetically desirable by not detracting from the view of and through the window structure, but it is functionally advantageous in that it does not interfere with proper hanging of blinds or curtains, nor is it susceptible to accidental contact which might scratch, bend or otherwise damage the actuator, nor is it susceptible to being accidentally or inadvertently unlocked from such contact. The lock actuator of the preferred embodiment also provides security against picking by a potential intruder. Moreover, all of these advantages may be obtained by a simple lock actuator which may be inexpensively manufactured, assembled, inventoried, shipped, installed and maintained for all types of installations.

It should also be recognized that the minimal intrusion of the lock actuator from the window frame advantageously allows the actuator to be completely assembled in a premade window assembly while still allowing such window assemblies to be efficiently and compactly shipped to the construction site. This can result in a significant reduction in shipping costs since more windows can be loaded on a single truck. Compact shipping in prior art structures might have been accomplished by not completely assembling the actuator on the window (for example, by leaving the handle off), but savings in shipping costs were offset by additional, probably less efficient, assembly required at the construction site, as well as the costs of parts and delays due to lost or misplaced handles not reaching the construction site with the windows.

Still other aspects, objects, and advantages of the present invention can be obtained from a study of the specification, the drawings, and the appended claims.

I claim:

1. A lock for securing a window sash against a window frame, said lock comprising:

a housing mountable on a face of said window frame, said housing including a first face surface that surrounds an opening in said housing;

a handle pivotable on said housing within said opening between a first position where a window sash is locked to a window frame and a second position where a window sash is released from a window frame, said handle having a second face surface which substantially occludes said housing opening when said handle is in said first position, said second face surface being substantially flush with said first face surface when the handle is in said first position;

a mechanism connector on each of said handle ends for selectively connecting one of said handle ends to a locking mechanism to secure said handle in its first position; and a locking connector on each of said handle ends for selectively connecting one of said handle ends to a locking member which is mountable on a window frame and is engageable with a keeper mountable on a window sash to secure the window frame to the window sash in a closed position.

2. The lock of claim 1, wherein movement of said handle from said first position to said second position may be manually initiated by pushing said handle second face at one end of said handle.

3. The lock of claim 1, wherein said handle is pivotable about an axis disposed between ends of the handle, and further comprising:

a recess in one of said handle ends; and a slide selectively movable into said handle recess whereby said slide blocks pivoting of said handle.

4. The lock of claim 1, wherein said housing first face surface is substantially planar, and said handle second face surface is substantially planar.

5. The lock of claim 4, wherein said housing first face surface and said handle second face surface are substantially co-planar when said handle is in said first position.

6. A lock for securing a window sash against a window frame, said lock comprising:

a housing mountable on a face of said window frame;

a handle extending generally longitudinally between first and second ends and pivotable in said housing about an axis disposed substantially halfway between said handle ends and oriented substantially transverse to the longitudinal direction of the handle;

a locking mechanism for locking a window sash to the window frame; and means on each of said handle ends for selectively connecting one of the handle ends to the locking mechanism.

7. The lock of claim 6, wherein said handle is substantially symmetrical about said axis.

8. The lock of claim 6, wherein said connecting means comprises a pivot at each end of the handle, and further comprising a pivot link pivotably securable on one end to a locking mechanism and pivotably securable on its other end to a selected one of the handle pivots.

9. The lock of claim 6, wherein:

said housing has a substantially planar first face substantially parallel to the window frame face when the housing is mounted to the window frame; and said handle has a substantially planar second face which is substantially co-planar with the housing first face when said handle is in a first position.

10. The lock of claim 9, wherein movement of said handle from a first position where the window sash is locked to the window frame to a second position where the window sash is released from the window frame may be manually initiated by pushing said handle second face at the end of said handle having the selectively connecting means.

11. A lock for securing a window sash against a window frame, said lock comprising:

at least one keeper mountable on a window sash;

at least one locking member mountable on a window frame for movement between a first position interfering with the at least one keeper mounted to the window sash to lock the window sash to the window frame when the window sash is in a closed position relative to the window frame and a second position clear of the at least one keeper to allow movement of the window sash relative to the window frame;

a housing mountable on a face of said window frame, said housing including a first face surface that surrounds an opening in said housing;

a handle extending generally longitudinally between first and second ends and pivotable in said housing opening about an axis disposed substantially halfway between said handle ends and oriented substantially transverse to the longitudinal direction of the handle;

a connector on each of the handle ends, either one of said connectors being selectively operably secured to the at least one locking member whereby pivoting of the handle moves the at least one locking member between the first position and the second position; and a second face surface on said handle which substantially occludes said housing opening when said handle is pivoted to place said at least one locking member in said first position, said second face surface being substantially flush with said first face surface when the handle is in said first position.

12. The lock of claim 11, wherein manual movement of said handle from said first position to said second position may be initiated by pushing said handle first face at one end of said handle.

13. The lock of claim 11, further comprising:

a second keeper, said keepers being mountable at spaced positions on the window sash;

a reciprocable tie bar mountable to a window frame and operably secured to said handle whereby pivoting of said handle moves said tie bar; and a second locking member, said locking members being mounted at spaced positions on said tie bar whereby reciprocation of said tie bar moves said locking members between said first position and said second position.

14. The lock of claim 11, wherein said locking member is a cam.

15. The lock of claim 11, wherein said handle is pivotable about an axis disposed between ends of the handle, and further comprising:

a recess in one of said handle ends; and a slide selectively movable into said handle recess whereby said slide blocks pivoting of said handle.

16. The lock of claim 11, wherein said housing first face surface is substantially planar, and said handle second face surface is substantially planar.

17. The lock of claim 16, wherein said housing first face surface and said handle second face surface are substantially co-planar when said handle is in said first position.

* * * * *